US012696990B2

(12) United States Patent
Mosley

(10) Patent No.: US 12,696,990 B2
(45) Date of Patent: Aug. 4, 2026

(54) ANTI-THEFT MAILBOX DEVICE

(71) Applicant: Joshua Mosley, Battle Creek, MI (US)

(72) Inventor: Joshua Mosley, Battle Creek, MI (US)

( * ) Notice: Subject to any disclaimer, the term of this patent is extended or adjusted under 35 U.S.C. 154(b) by 0 days.

(21) Appl. No.: 18/904,502

(22) Filed: Oct. 2, 2024

(65) Prior Publication Data

US 2026/0090670 A1 Apr. 2, 2026

(51) Int. Cl.
*A47G 29/14* (2006.01)
*A47G 29/122* (2006.01)
*A47G 29/30* (2006.01)

(52) U.S. Cl.
CPC ..... *A47G 29/141* (2013.01); *A47G 29/122* (2013.01); *A47G 29/30* (2013.01); *A47G 2029/146* (2013.01); *A47G 2029/148* (2013.01)

(58) Field of Classification Search
CPC ..... A47G 29/141; A47G 29/30; A47G 29/20; A47G 29/122; A47G 29/124; A47G 2029/145; A47G 2029/146; A47G 2029/148; A47G 2029/149; A47G 2200/08
See application file for complete search history.

(56) References Cited

U.S. PATENT DOCUMENTS 5,774,053 A * 6/1998 Porter ..... A47G 29/141 340/568.1
5,917,411 A * 6/1999 Baggarly ..... A47G 29/1212 340/569
5,950,919 A * 9/1999 Adams ..... A47G 29/1214 340/569
5,975,713 A * 11/1999 Brothers ..... F21S 9/03 362/802
5,979,750 A * 11/1999 Kindell ..... A47G 29/141 232/1 R
6,788,203 B1 * 9/2004 Roxbury ..... G08B 13/08 232/35
6,967,575 B1 * 11/2005 Dohrmann ..... G06Q 20/367 340/5.31
7,222,779 B1 * 5/2007 Pineda-Sanchez ..... A47G 29/1214 340/569
7,256,691 B2 8/2007 Awobue
7,486,948 B1 * 2/2009 Vergon ..... A47G 29/1214 455/412.2
7,506,796 B1 * 3/2009 Hanna ..... A47G 29/1214 340/569

(Continued)

FOREIGN PATENT DOCUMENTS

CA 3117706 A1 * 5/2020 ..... G08B 13/19684
KR 102033638 B1 * 10/2019 ..... A47G 29/1214

*Primary Examiner* — William L Miller

(57) ABSTRACT

An anti-theft mailbox device for preventing mail theft includes a box having an open front side and an interior space. A front door is positionable to cover the open front side. A processor is coupled to the box. A front lock is electrically coupled to the processor. The front lock is actuatable to inhibit the front door from being opened. A proximity sensor coupled to the box is designed to detect when a user is approaching the box. The processor actuates the front lock when the proximity sensor detects that the user is approaching the box. A camera is electrically coupled to the processor. The processor actuates the camera to capture a photograph of the user when the user attempts to pivot the front door into the front door open position.

13 Claims, 7 Drawing Sheets

(56) References Cited

U.S. PATENT DOCUMENTS 7,786,862 B1 * 8/2010 Campbell ..... A47G 29/1214 340/569
9,211,025 B1 12/2015 Elhawwashy
9,469,476 B1 * 10/2016 Ashoori ..... H04W 4/02
9,918,577 B1 * 3/2018 Brown ..... A47G 29/1214
10,028,111 B2 * 7/2018 Ansari ..... A47G 29/121
10,039,401 B1 * 8/2018 Romanucci ..... A47G 29/141
10,292,519 B1 * 5/2019 Sutton ..... A47G 29/141
10,455,965 B1 * 10/2019 Amati ..... A47G 29/1225
10,772,450 B2 * 9/2020 Waisanen ..... G07C 9/00912
10,827,867 B1 * 11/2020 Vangi ..... H04W 4/12
11,103,096 B1 * 8/2021 Parr ..... A47G 29/1225
11,172,776 B1 * 11/2021 Logan ..... G08B 13/14
11,250,652 B2 * 2/2022 Sengstaken, Jr. .. G06K 7/10366
11,324,350 B1 * 5/2022 Boggs ..... B65D 81/24
11,571,079 B1 * 2/2023 Faizan ..... E05C 1/08
11,672,371 B1 * 6/2023 Paulo ..... G06Q 10/0836 340/568.1
11,759,040 B2 * 9/2023 Richardson ..... G06Q 10/0836 705/332
11,812,878 B1 * 11/2023 Nevison ..... H04L 9/0643
11,928,642 B2 * 3/2024 Ruocco ..... G07C 9/00896
11,941,962 B2 * 3/2024 Ludington ..... A47G 29/1214
12,016,479 B1 * 6/2024 Preston ..... G07C 9/0069
12,022,969 B1 * 7/2024 Waltereze ..... A47G 29/141
2003/0231112 A1 * 12/2003 Raju ..... G07C 9/27 340/569
2004/0133304 A1 * 7/2004 Fobbe ..... G07C 9/33 700/214
2008/0040243 A1 * 2/2008 Chang ..... A47G 29/1214 705/28
2015/0081580 A1 3/2015 Fry
2016/0374494 A1 * 12/2016 Geng ..... A47G 29/16 232/17
2017/0091710 A1 3/2017 Van Dyke
2017/0286905 A1 10/2017 Richardson
2017/0295979 A1 * 10/2017 Appell ..... A47G 29/1214
2018/0029760 A1 * 2/2018 Maser ..... B65D 43/16
2018/0070753 A1 3/2018 Eveloff
2018/0177319 A1 * 6/2018 Willis ..... G06Q 10/1097
2018/0177320 A1 * 6/2018 Chambers ..... E05B 65/52
2019/0000255 A1 * 1/2019 Dehner ..... B65D 43/26
2019/0167024 A1 * 6/2019 Bradish ..... A47G 29/121
2019/0167025 A1 * 6/2019 Cherry ..... A47G 29/16
2019/0343317 A1 * 11/2019 Cantrell ..... G07C 9/00563
2020/0000261 A1 * 1/2020 Chambers ..... G07C 9/00896
2020/0077826 A1 * 3/2020 Chenier ..... G07C 9/00912
2020/0138225 A1 * 5/2020 Martin ..... B65D 55/02
2020/0163480 A1 * 5/2020 Waisanen ..... E05B 65/06
2020/0219346 A1 * 7/2020 Dhannawat ..... G07C 9/00571
2021/0045563 A1 * 2/2021 Bartley-Clark ..... A47G 29/141
2021/0059455 A1 * 3/2021 Bowman ..... B65D 81/18
2021/0148157 A1 * 5/2021 Muniz ..... G07C 9/00309
2021/0196071 A1 * 7/2021 Gecho ..... A47G 29/30
2021/0251409 A1 * 8/2021 Kennett ..... A47G 29/141
2021/0321807 A1 * 10/2021 Needler ..... G07C 9/00912
2022/0022678 A1 * 1/2022 Horn ..... A47G 29/141
2022/0058575 A1 * 2/2022 Moudy ..... G07F 9/002
2022/0142388 A1 * 5/2022 Foster ..... A47G 29/141
2022/0225810 A1 * 7/2022 Mack ..... G07C 9/20
2022/0240704 A1 * 8/2022 Castagno ..... A47G 29/1209
2022/0267048 A1 * 8/2022 Rogers ..... A47G 29/30
2022/0279953 A1 * 9/2022 Crawford ..... A47G 29/1207
2022/0296023 A1 * 9/2022 Fernandez ..... A47G 29/141
2022/0338658 A1 * 10/2022 Soderberg ..... A47G 29/141
2023/0032389 A1 * 2/2023 Barros ..... E05B 47/026
2023/0074283 A1 * 3/2023 Malcolm ..... G06Q 10/0836
2023/0218100 A1 * 7/2023 Meyrowitz ..... A47G 29/16 340/569
2023/0264871 A1 * 8/2023 Williams ..... A47G 29/141 340/5.7
2023/0320511 A1 * 10/2023 Ferrara ..... A47G 29/16 232/39
2024/0197096 A1 * 6/2024 Felder ..... A47G 29/141
2024/0423405 A1 * 12/2024 Meyrowitz ..... A61L 2/24
2025/0024977 A1 * 1/2025 Sundaresan ..... G08B 13/1463

* cited by examiner

ANTI-THEFT MAILBOX DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mailboxes and more particularly pertains to a new mailbox for preventing mail theft.

(2) Description of Related Art Including Information Disclosed Under 37 CFR 1.97 and 1.98

The prior art relates to mailboxes. Mailboxes provide a convenient receptacle for receiving the mail. Conventional mailboxes do not have any locks or other anti-theft measures. Some mailboxes have mechanical locks that can be opened with a key, providing a moderate amount of protection against unauthorized access to the mail within the mailbox. However, those locking mailboxes are subject to failure, because the locks are typically small and relatively easy to either break or pick. Additionally, the physical key can be lost or stolen. Previous users of the mailbox may also retain copies of the physical key, posing another security risk. Thus, there is a need for a mailbox with an improved lock that provides better security over the delivered mail. Ideally, such a mailbox would also include additional security features, such as a camera, to further deter mail theft and to facilitate apprehension of individuals who do attempt mail theft.

BRIEF SUMMARY OF THE INVENTION

An embodiment of the disclosure meets the needs presented above by generally comprising a box having an open front side and an interior space. A front door is coupled to the box. The front door is positionable to cover the open front side of the box. A processor is coupled to the box. A front lock is electrically coupled to the processor. The front lock is coupled to the front door. The front lock is actuatable to inhibit the front door from being opened wherein the front lock is configured to selectively inhibit access to the interior space. The front lock engages the front door to retain the front door in a front door closed position when the front lock is activated. The front lock disengages from the front door to allow the front door to be pivoted into a front door open position when the front lock is deactivated. A proximity sensor is coupled to the box. The proximity sensor is configured to detect when a user is approaching the box. The processor is configured to actuate the front lock when the proximity sensor detects that the user is approaching the box. A camera is electrically coupled to the processor. The processor actuates the camera to capture a photograph of the user when the user attempts to pivot the front door into the front door open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
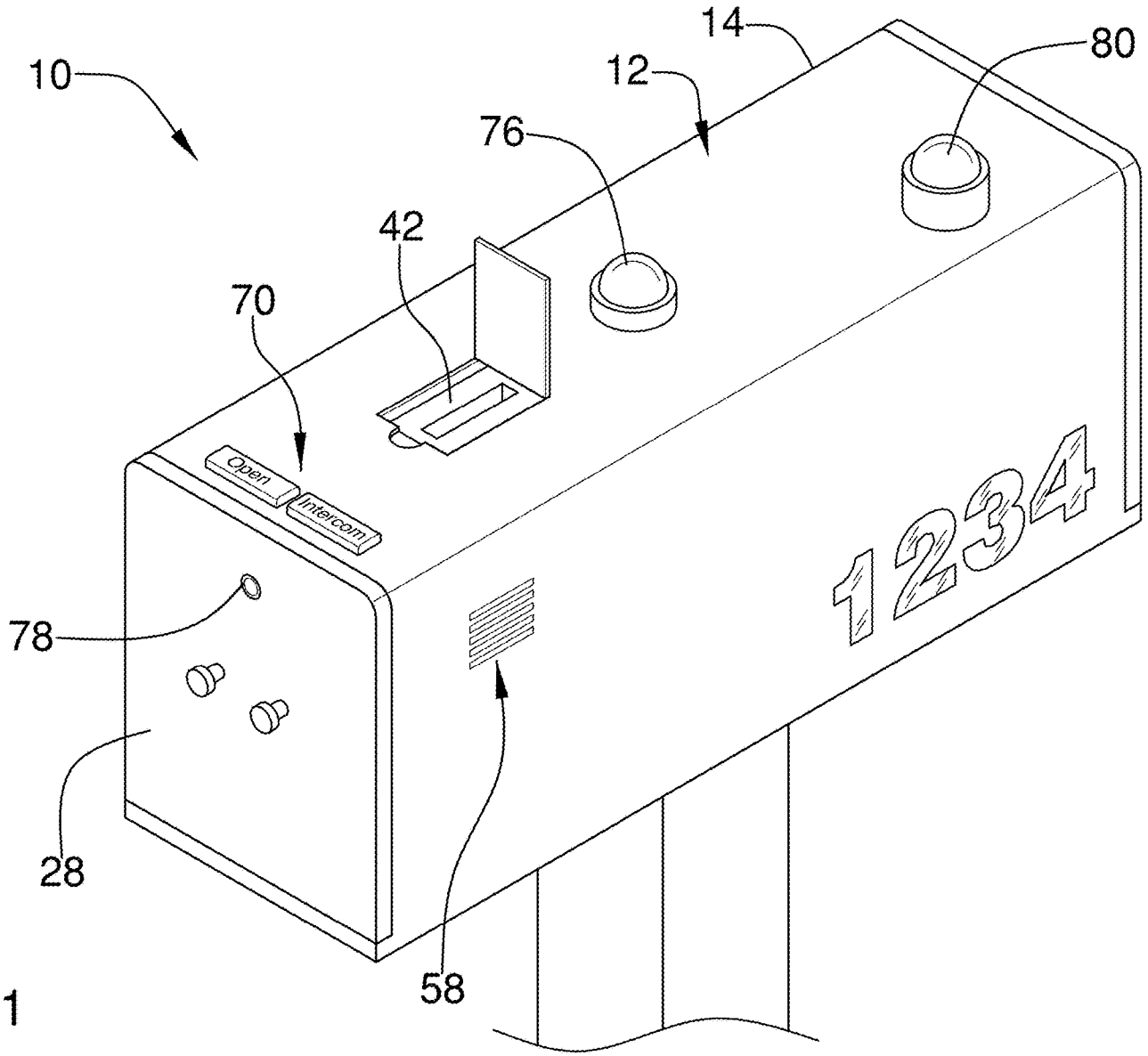
FIG. 1 is a front isometric view of an anti-theft mailbox device according to an embodiment of the disclosure.

With reference now to the drawings, and in particular to FIGS. 1 through 8 thereof, a new mailbox embodying the principles and concepts of an embodiment of the disclosure and generally designated by the reference numeral 10 will be described.

As best illustrated in FIGS. 1 through 8, the anti-theft mailbox device 10 generally comprises a box 12 having a peripheral wall 14 with an open front side 16. The box 12 may also have an open rear side 18. The peripheral wall 14 generally includes a top side 20, a bottom side 22, and a pair of lateral sides 24 that are each coupled to and extend between the top side 20 and the bottom side 22 to define an interior space 26.

A front door 28 is pivotably coupled to the box 12. The front door 28 is positionable to cover the open front side 16 of the box 12. The front door 28 is generally pivotable between a front door open position 30 and a front door closed position 32. For example, the front door 28 may be positioned on the bottom side 22 of the peripheral wall 14 of the box 12. In such embodiments, the front door 28 may be parallel to and extend outwardly from the bottom side 22 of the peripheral wall 14 when the front door 28 is in the front door open position 30 wherein the front door open position 30 allows access to the interior space 26. The front door 28 may be perpendicular to and extend upwardly from the bottom side 22 of the peripheral wall 14 when the front door 28 is in the front door closed position 32 wherein the front door closed position 32 inhibits access to the interior space 26.

A rear door 34 may be pivotably coupled to the box 12. The rear door 34 is positionable to cover the open rear side 18 of the box 12. The rear door 34 is generally pivotable between a rear door open position 36 and a rear door closed position 38. For example, the rear door 34 may be positioned on the bottom side 22 of the peripheral wall 14 of the box 12. The rear door 34 may be parallel to and extend outwardly from the bottom side 22 of the peripheral wall 14 when the rear door 34 is in the rear door open position 36 wherein the rear door open position 36 allows access to the interior space 26. The rear door 34 may be perpendicular to and extend upwardly from the bottom side 22 of the peripheral wall 14 when the rear door 34 is in the rear door closed position 38 wherein the rear door closed position 38 inhibits access to the interior space 26.

A power source 40 may be coupled to the box 12. For example, the power source 40 may comprise a battery. The battery may be rechargeable. A charging port 42 may be electrically coupled to the power source 40. For example, the charging port 42 may be inset into the top side 20 of the peripheral wall 14. The charging port 42 may be exposed within the top side 20 of the peripheral wall 14, as shown in FIG. 1. In another example, a power source access door 44 may be pivotably coupled to the top side 20 of the peripheral wall 14 wherein the power source access door 44 is selectively openable to allow access to the power source 40.

A processor 46 may be electrically coupled to the power source 40. The processor 46 may be positioned in the interior space 26 of the box 12. For example, the processor 46 may be positioned adjacent to the bottom side 22 of the peripheral wall 14. The processor 46 may include a memory unit 48. The memory unit 48 may store an audio file. The audio file may include a warning statement that is configured to inhibit a user from tampering with the box 12. For example, the warning statement may include statements such as "attempted unauthorized access detected, notifying resident," "we now have your picture," and "please cease your unauthorized attempts to open this box." The audio file may also include an informational statement that is configured to identify an address associated with the box 12. For example, the informational statement may include a street address associated with the box 12 or the name of a resident who uses the box 12 for mail deliveries.

A transceiver 50 may be electrically coupled to the processor 46. The transceiver 50 is configured to wirelessly communicate with a personal electronic device 52. The transceiver 50 is generally configured to send data to and receive data from the personal electronic device 52. The transceiver 50 may also be configured to send audio to and receive audio from the personal electronic device 52. The personal electronic device 52 may include a cellular telephone or a tablet owned by the resident, or other individual, who receives deliveries via the box 12. The personal electronic device 52 may have a software code or an application that is configured to facilitate the resident in actuating the processor 46 in various ways which will become evident throughout this specification.

A clock 54 may be electrically coupled to the processor 46. The clock 54 may be configured to monitor a time of day in minutes and hours. The clock 54 may include a timer 56. The timer 56 may have a timer active setting and a timer inactive setting. The timer active setting may be configured to be adjustable with the personal electronic device 52. The timer inactive setting may be configured to be adjustable with the personal electronic device 52.

A speaker 58 may be electrically coupled to the processor 46. The processor 46 is generally configured to play the audio file audibly with the speaker 58. The processor 46 may also be configured to play audio received from the personal electronic device 52 audibly with the speaker 58.

The speaker 58 may include a first speaker element that is positioned on a first lateral side of the pair of lateral sides 24 of the peripheral wall 14 of the box 12. For example, the first speaker element may be positioned proximate to the open front side 16 of the box 12. A second speaker element may be positioned on a second lateral side of the pair of lateral sides 24 of the peripheral wall 14 of the box 12. The second speaker element may be positioned proximate to the open front side 16 of the box 12. The second speaker element may be aligned with the first speaker element across the box 12.

A microphone 60 may be electrically coupled to the processor 46. The microphone 60 is configured to detect an audio feed proximate to the box 12. The transceiver 50 may be configured to send the audio feed to the personal electronic device 52 wherein the speaker 58 and the microphone 60 are configured to facilitate voice communication between the personal electronic device 52 and the user. For example, the microphone 60 may be a pinhole microphone 60 that is integrated into the speaker 58.

The microphone 60 may include a first microphone element that is integrated into the first speaker element wherein the first microphone element is configured to detect the audio feed proximate to the first lateral side of the pair of lateral sides 24 of the box 12. A second microphone element may be integrated into the second speaker element wherein the second microphone element is configured to detect the audio feed proximate to the second lateral side of the pair of lateral sides 24 of the box 12.

A front lock 62 may be electrically coupled to the processor 46. The front lock 62 is coupled to the front door 28. The front lock 62 is actuatable to inhibit the front door 28 from being pivoted into the front door open position 30 wherein the front lock 62 is configured to selectively inhibit access to the interior space 26. The front lock 62 engages the front door 28 to retain the front door 28 in the front door closed position 32 when the front lock 62 is activated. The front lock 62 disengages from the front door 28 to allow the front door 28 to be pivoted into the front door open position 30 when the front lock 62 is deactivated. The front lock 62 may be positioned on the top side 20 of the peripheral wall 14 of the box 12. The front lock 62 may be positioned in the interior space 26. The front lock 62 may be an electromagnetic lock.

The processor 46 may activate the front lock 62 when the timer 56 is in the timer active setting. The processor 46 may deactivate the front lock 62 when the timer 56 is in the timer inactive setting. For example, the resident may use the personal electronic device 52 to enter a time frame during which the user, who may be a mail delivery person, typically makes deliveries as the timer inactive setting. The processor 46 may deactivate the front lock 62 during the time frame entered for the timer inactive setting so that the mail delivery person can open the front door 28 to deposit mail into the interior space 26 of the box 12. Once the time frame has expired, the timer 56 may switch to the timer inactive setting and the processor 46 may activate the front lock 62 to inhibit unauthorized individuals from opening the front door 28 to access the mail which was delivered.

Figure 2:
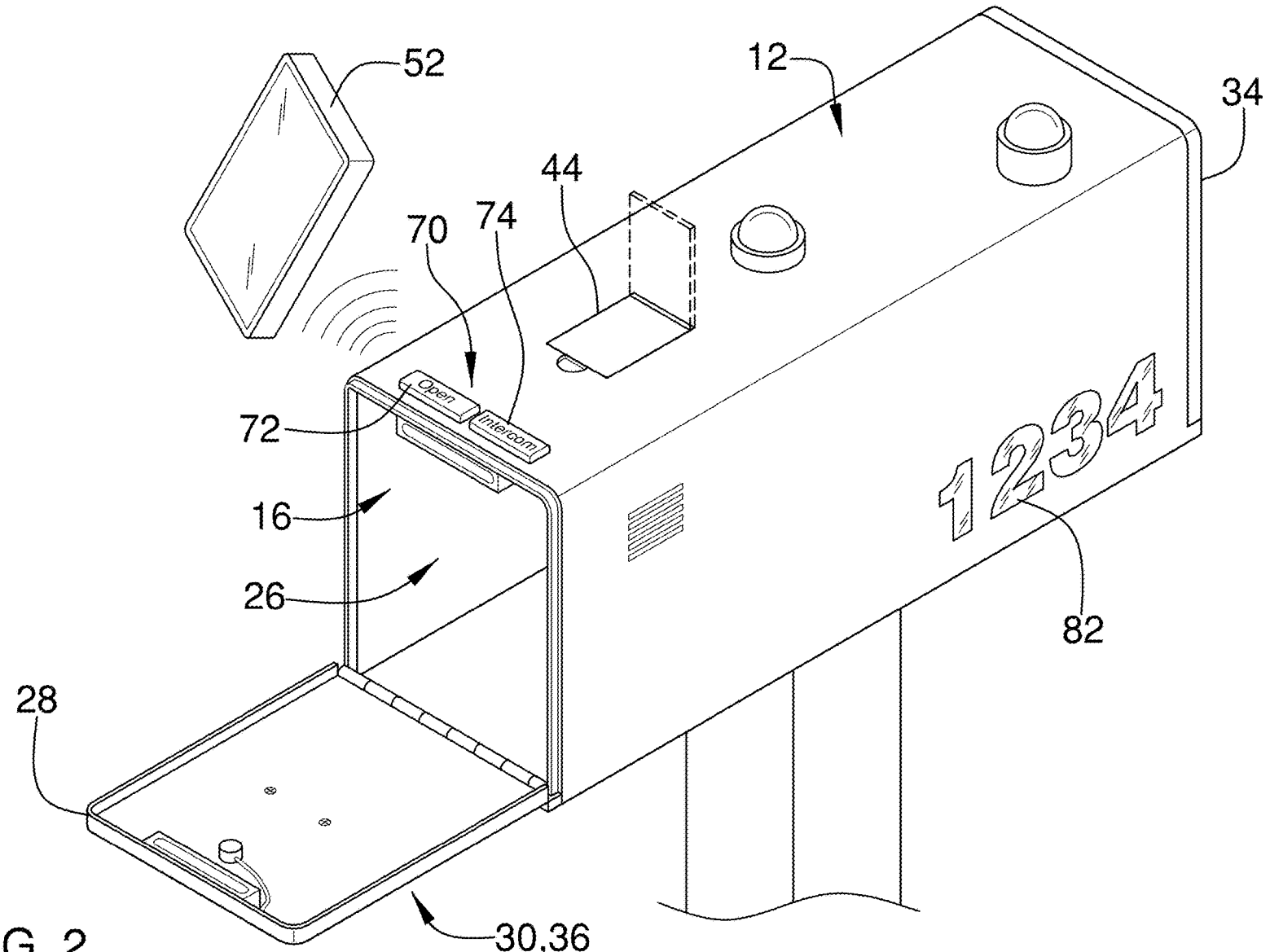
FIG. 2 is a front isometric view of an embodiment of the disclosure.
Figure 3:
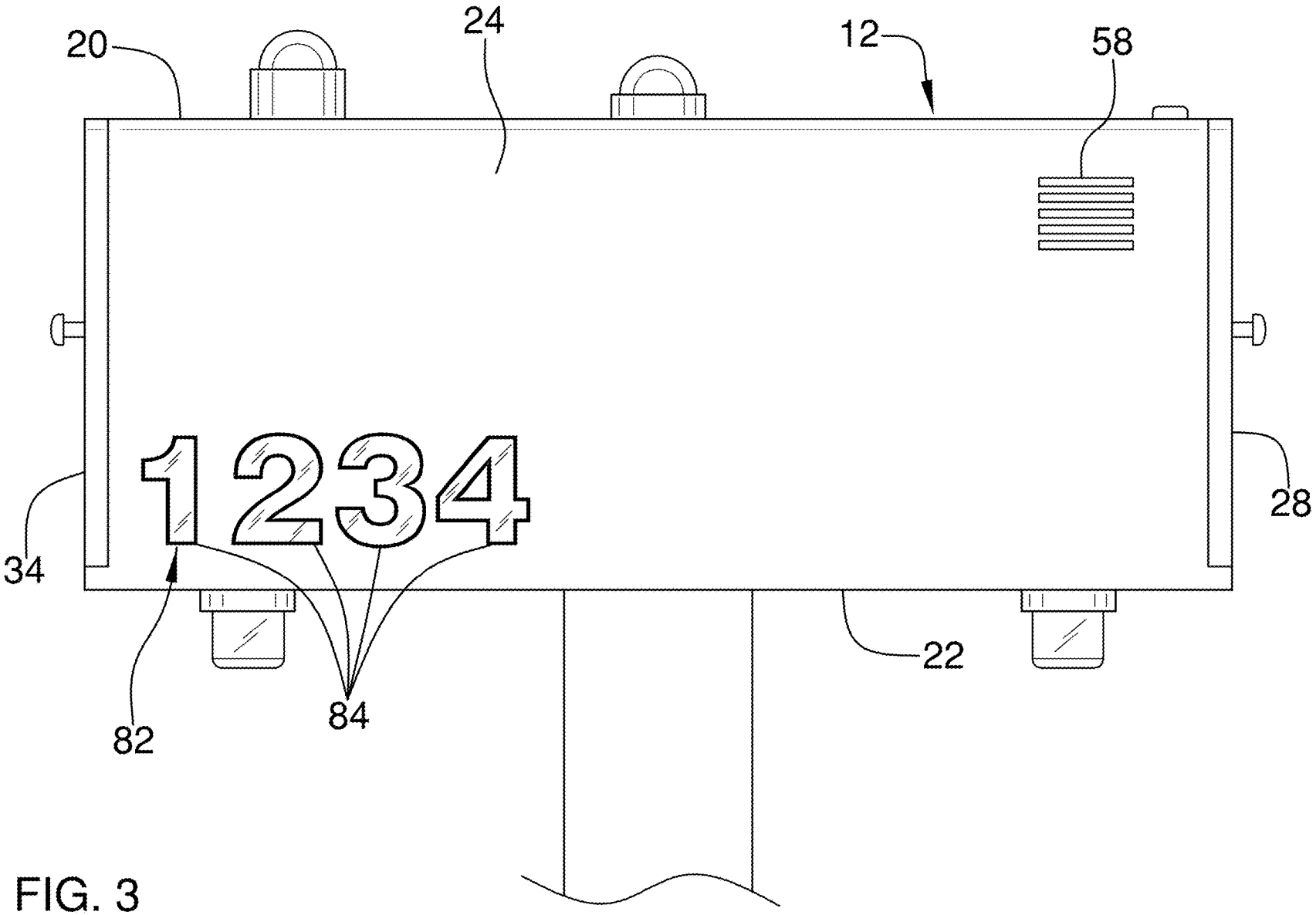
FIG. 3 is a side view of an embodiment of the disclosure.
Figure 5:
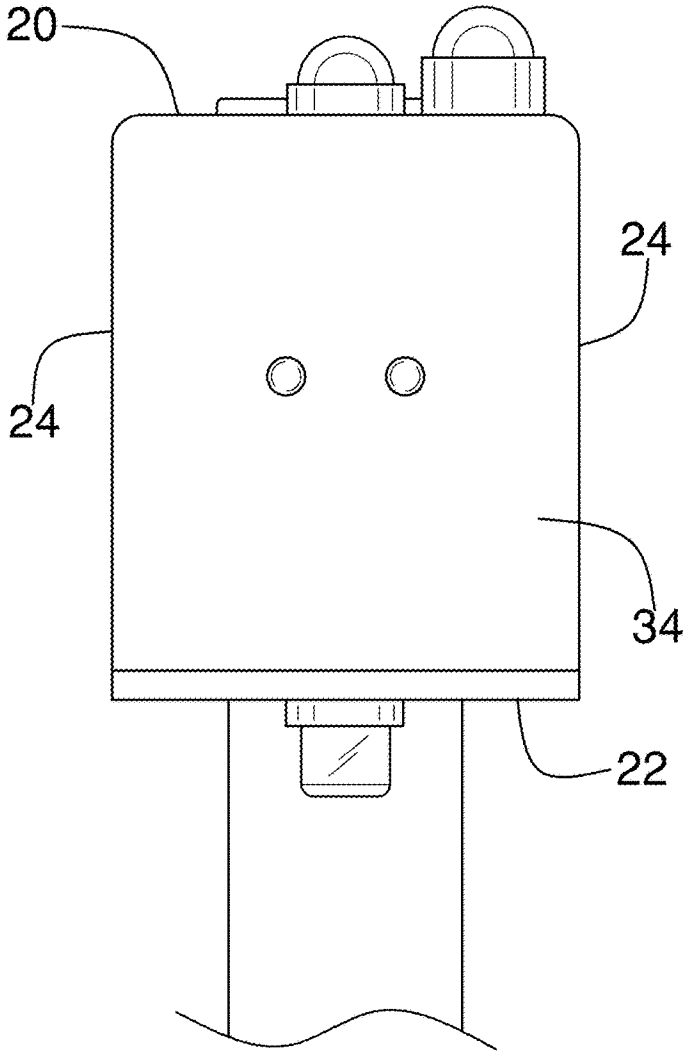
FIG. 5 is a rear view of an embodiment of the disclosure.
Figure 4:
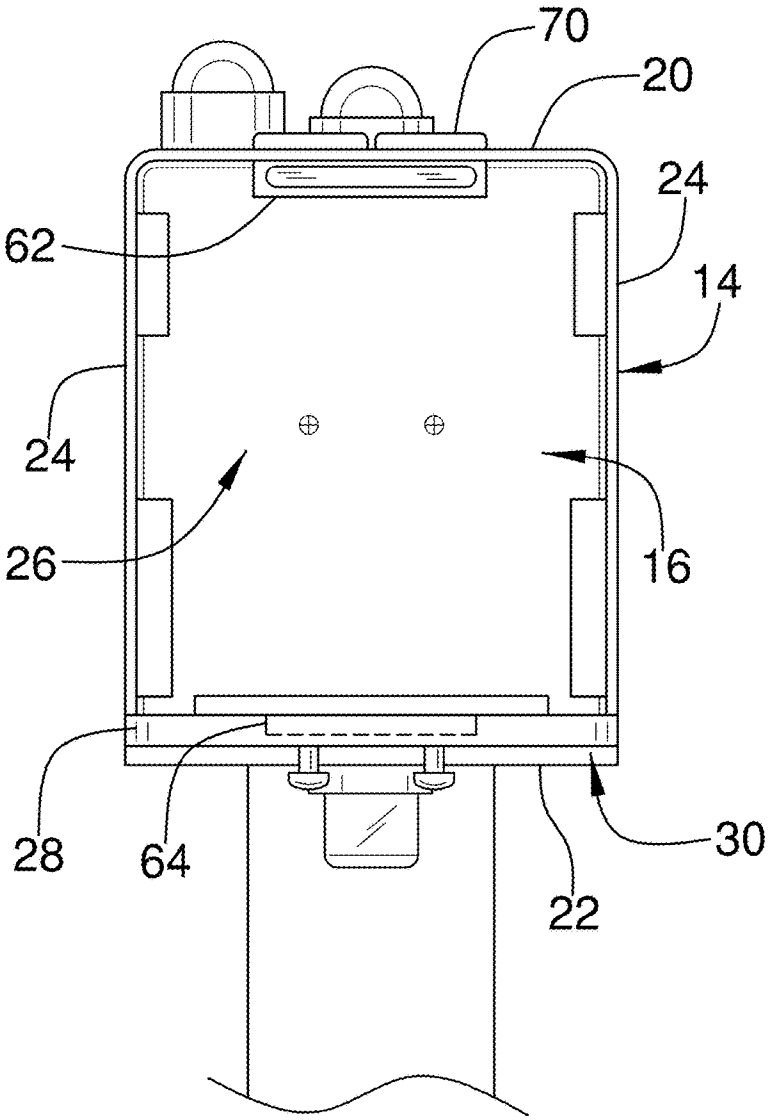
FIG. 4 is a front view of an embodiment of the disclosure.
Figure 6:
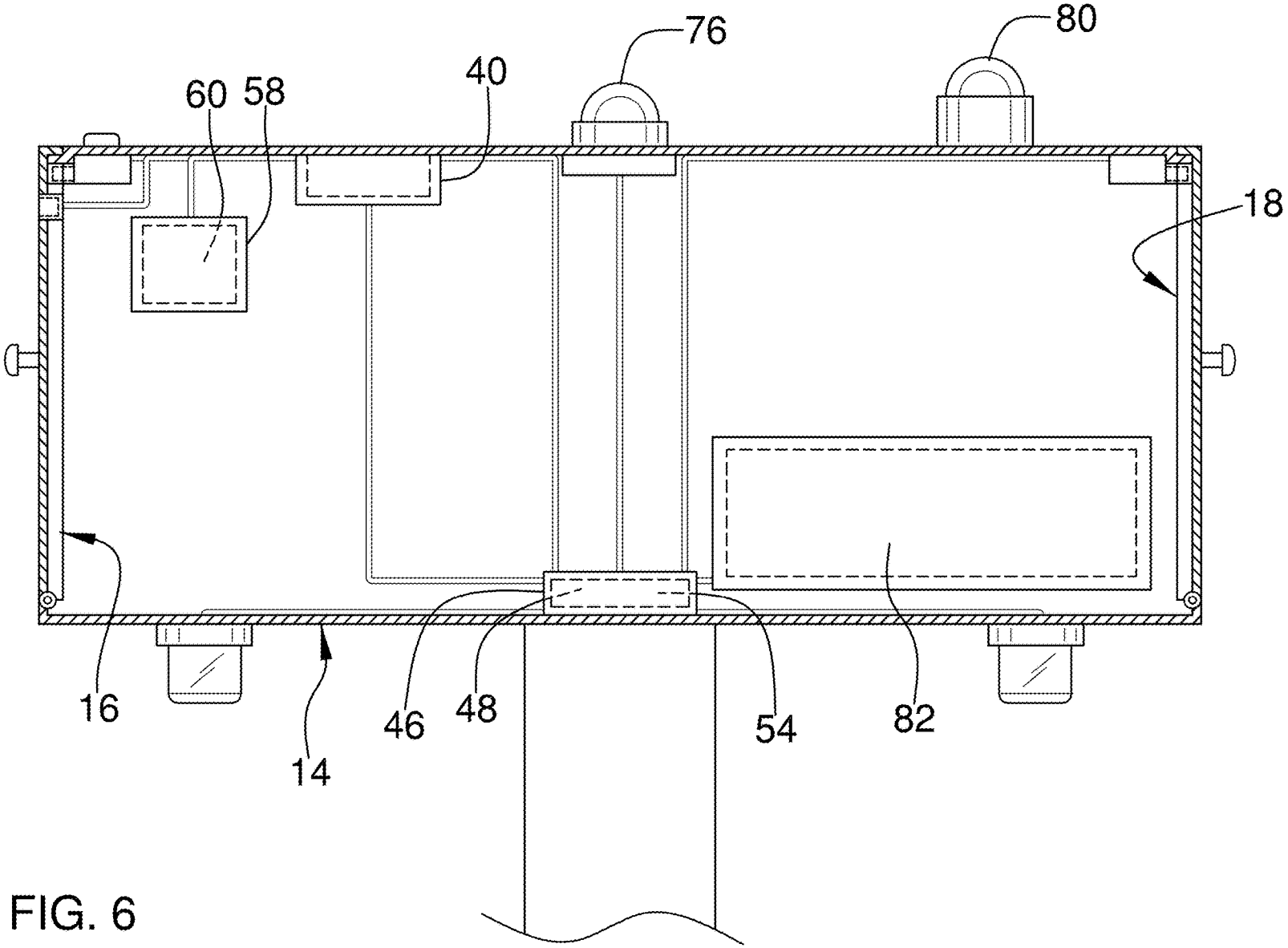
FIG. 6 is a cross-sectional view of an embodiment of the disclosure.
Figure 7:
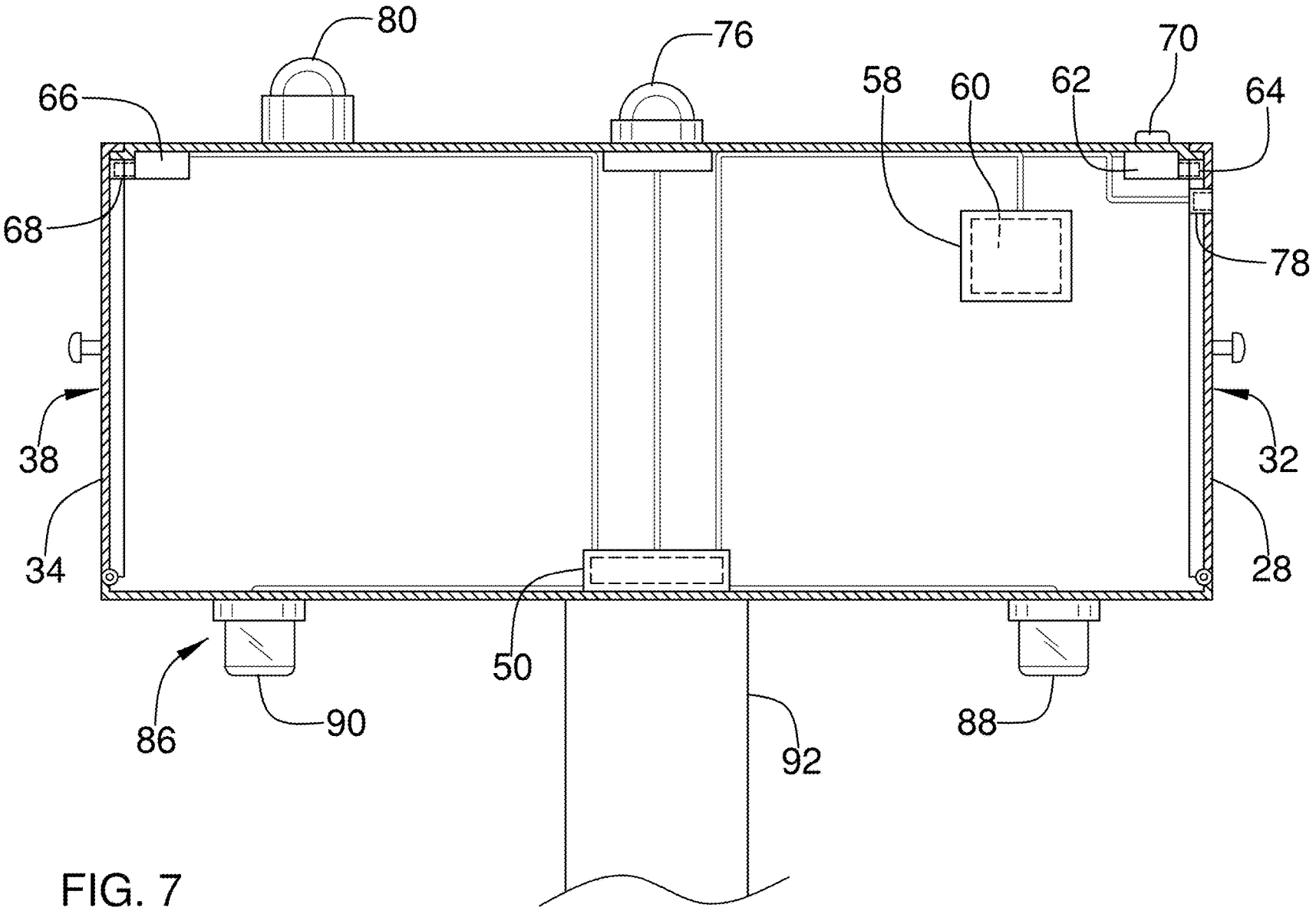
FIG. 7 is a cross-sectional view of an embodiment of the disclosure.
Figure 8:
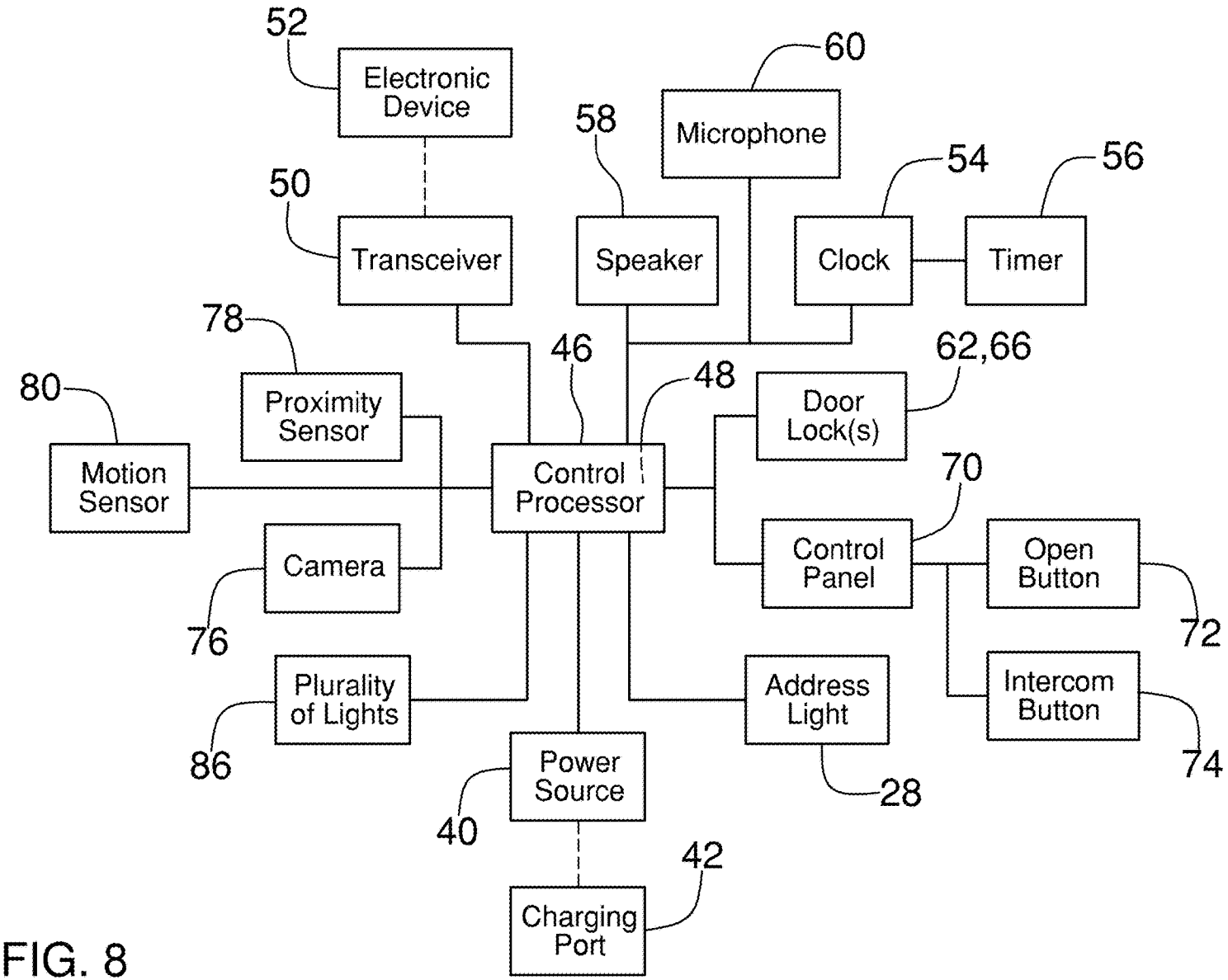
FIG. 8 is a block diagram view of an embodiment of the disclosure.

A front door magnetically active material 64 may be coupled to the front door 28. The front door magnetically active material 64 is alignable with the front lock 62 when the front door 28 is in the front door closed position 32. The front door magnetically active material 64 is magnetically attracted to the front lock 62 when the front lock 62 is activated to retain the front door 28 in the front door closed position 32. As shown in FIG. 2, the front door magnetically active material 64 may be a piece of material coupled to an interior surface of the front door 28. In other embodiments, the front door 28 itself may comprise the front door magnetically active material 64.

A rear lock 66 may be electrically coupled to the processor 46. The rear lock 66 is coupled to the rear door 34. The rear lock 66 is actuatable to inhibit the rear door 34 from being pivoted into the rear door open position 36 wherein the rear lock 66 is configured to selectively inhibit access to the interior space 26. The rear lock 66 engages the rear door 34 to retain the rear door 34 in the rear door closed position 38 when the rear lock 66 is activated. The rear lock 66 disengages the rear door 34 to allow the rear door 34 to be pivoted into the rear door open position 36 when the rear lock 66 is deactivated. The rear lock 66 may be positioned on the top side 20 of the peripheral wall 14 of the box 12. The rear lock 66 may be positioned in the interior space 26. The rear lock 66 may be an electromagnetic lock.

The processor 46 may activate the rear lock 66 when the timer 56 is in the timer active setting. The processor 46 may deactivate the rear lock 66 when the timer 56 is in the timer inactive setting. Like with the front lock 62, the resident may use the personal electronic device 52 to adjust the time frame for the timer active setting and the timer inactive setting, for example based on an expected delivery time.

A rear door magnetically active material 68 may be coupled to the rear door 34. The rear door magnetically active material 68 is alignable with the rear lock 66 when the rear door 34 is in the rear door closed position 38. The rear door magnetically active material 68 is magnetically attracted to the rear lock 66 when the rear lock 66 is activated to retain the rear door 34 in the rear door closed position 38. The rear door magnetically active material 68 may comprise a piece of material coupled to an inner surface of the rear door 34, which may look similar to the front door magnetically active material 64 shown in FIG. 2. Alternatively, the rear door 34 itself may comprise the rear door magnetically active material 68.

A control panel 70 may be electrically coupled to the processor 46. The control panel 70 may be positioned on the top side 20 of the peripheral wall 14, for example adjacent to the front door 28 wherein the control panel 70 is configured to be accessible to the user when the user is attempting a mail delivery through the front door 28. The control panel 70 may be actuatable to signal the processor 46 to actuate the front lock 62, the rear lock 66, and the microphone 60.

For example, the control panel 70 may include an open button 72 that is configured to signal the processor 46 to deactivate the front lock 62. The open button 72 may also signal the processor 46 to deactivate the rear lock 66. Some embodiments may include a single open button 72 as shown in the Figures. Other embodiments may include a pair of open buttons, each of which is configured to signal the processor 46 to deactivate a respective one of the front lock 62 and the rear lock 66.

When the user presses the open button 72 and the timer 56 is in the timer inactive setting, the processor 46 may deactivate the front lock 62 and the rear lock 66. The processor 46 may be inhibited from deactivating the front lock 62 and the rear lock 66 when the timer 56 is in the timer active setting. The processor 46 may be configured to audibly play the informational statement of the audio file audibly with the speaker 58 when the open button 72 signals the processor 46 to deactivate the front lock 62. The informational statement may facilitate the mail delivery person in accurately identifying the street address or the resident to help ensure that mail is delivered to the correct address.

For example, the user, or mail delivery person, may press the open button 72 to release the front door 28 from the front lock 62 and deposit the mail. After delivery, the transceiver 50 may transmit a delivery alert to the personal electronic device 52, notifying the resident that the mail has been delivered. The resident may remotely activate the front lock 62 and the rear lock 66 using the personal electronic device 52 to inhibit unauthorized individuals from accessing the mail which has been delivered.

The control panel 70 may also include an intercom button 74 that is configured to signal the processor 46 to actuate the microphone 60. For example, the mail delivery person, or other user, may press the intercom button 74 to enable the voice communication with the resident. In some embodiments, the mail delivery person may hold the intercom button 74 down while the mail delivery person is speaking and may release the intercom button 74 to listen to responses from the resident. Such embodiments may function similar to a walkie talkie or other long range two-way radio. In other embodiments, the user may press the intercom button 74 once to initiate the voice communication with the resident, and the user may press the intercom button 74 twice to terminate the voice communication with the resident. Alternative methods of use of the intercom button 74 are also contemplated, and these embodiments are intended as illustrative examples rather than a comprehensive or closed list.

A camera 76 may be electrically coupled to the processor 46. The camera 76 may be mounted to the top side 20 of the peripheral wall 14. The camera 76 may be an omnidirectional camera 76 having a 360° field of view around the box 12. The processor 46 may actuate the camera 76 to capture a photograph when the open button 72 of the control panel 70 is actuated while the timer 56 is in the timer active setting. The processor 46 may be configured to actuate the camera 76 to capture the photograph when the user attempts to pivot the front door 28 into the front door open position 30 while the timer 56 is in the timer active setting. The processor 46 may be configured to actuate the camera 76 to capture the photograph when the user attempts to pivot the rear door 34 into the rear door open position 36 while the timer 56 is in the timer active setting. In some embodiments, the processor 46 may be configured to actuate the camera 76 to capture the photograph when the user attempts to pivot the front door 28 and the rear door 36 into the front door open position 30 and the rear door open position 36, respectively, while the front lock 62 and the rear lock 66, respectively, are activated.

The transceiver 50 may be configured to transmit the photograph to the personal electronic device 52 such that the resident can view the photograph. The processor 46 may be configured to play the warning statement of the audio file audibly with the speaker 58 when the camera 76 captures the photograph. For example, when the user presses the open button 72 to attempt unauthorized access to the mail which has been delivered, the camera 76 may capture the photograph to capture an image of the user. The processor 46 may play the warning statement, such as "we now have your picture," audibly with the speaker 58. The warning statement may warn the user that their attempts at accessing the mail have been detected, which may deter the user from continuing their attempts.

The camera 76 may have a night vision setting that is configured to capture the photograph of the user when the time of day is monitored by the clock 54 is a nighttime, which typically has low light conditions. For example, the nighttime may be between a sunrise time and a sunset time. The transceiver 50 may be configured to transmit the sunrise time and the sunset time from the personal electronic device 52 to the processor 46. Alternatively, the resident may use the personal electronic device 52 to specify the time of day which is the nighttime.

A proximity sensor 78 may be coupled to the box 12. The proximity sensor 78 may be positioned on the front door 28 wherein the proximity sensor 78 is configured to detect when the user is approaching the front door 28 of the box 12. The processor 46 may be configured to actuate the front lock 62 and the rear lock 66 when the proximity sensor 78 detects the user is approaching the box 12. The transceiver 50 may be configured to send a proximity alert to the personal electronic device 52 when the proximity sensor 78 detects the user is approaching the box 12. The processor 46 may actuate the camera 76 to capture the photograph of the user based on a location of the user that is detected by the proximity sensor 78. For example, when the user is within 1 foot of the front door 28 of the box 12, the processor 46 may actuate the camera 76 to focus on an area approximately 1 foot in front of the front door 28 to capture the photograph.

In some embodiments, the resident may see the proximity alert and view a live feed from the camera 76 to determine who is approaching the box 12. Using the live feed, the resident may be able to determine whether the person approaching the box 12 is an authorized mail delivery person or an unauthorized individual who may be attempting unauthorized access to the mail which has been deposited into the interior space 26 of the box 12.

A motion sensor 80 may be electrically coupled to the processor 46. The motion sensor 80 is coupled to the box 12. The motion sensor 80 may be positioned on the top side 20 of the peripheral wall 14. The motion sensor 80 may be spaced from the camera 76 wherein the field of view of the camera 76 is configured to be unobstructed by the motion sensor 80. The motion sensor 80 may have a height that exceeds a height of the camera 76 wherein a field of view the motion sensor 80 is configured to be unobstructed by the camera 76.

The motion sensor 80 is generally configured to detect when the user is approaching the box 12. The proximity sensor 78 may detect when the user is specifically approaching the front door 28 of the box 12. The motion sensor 80 may detect when the user is approaching the box 12 from another direction. Alternatively, the proximity sensor 78 may detect the user's approach once the user is within a certain distance of the box. The motion sensor 80 may detect the approach of the user from a greater distance. For example, the motion sensor 80 may detect when the user is approaching the property or address associated with the box 12. For example, the motion sensor 80 may detect that the user is pulling into the driveway or up to the curb next to the box 12.

An address light 82 may be electrically coupled to the processor 46. The address light 82 may be coupled to the box 12. For example, the address light 82 may be positioned on one or both of the pair of lateral sides 24 of the peripheral wall 14. The address light 82 may be positioned proximate to the open rear side 18. The address light 82 may include an indicium 84 or shape that is configured to indicate the mailing address associated with the box 12. For example, the indicium 84 or shape of the address light 82 may correspond to a house number of the mailing address.

The processor 46 may actuate the address light 82 when the front door 28 is pivoted into the front door open position 30 wherein the address light 82 is configured to facilitate the user in delivering the mail to the correct address. The processor 46 may also actuate the address light 82 when the rear door 34 is pivoted into the rear door open position 36 wherein the address light 82 is configured to facilitate visibility of the box 12. The processor 46 may actuate the address light 82 when the transceiver 50 sends the proximity alert to the personal electronic device 52, wherein the address light 82 is configured to facilitate the user in visualizing the mailing address as the user approaches the box 12. The processor 46 may be configured to actuate the address light 82 when the motion sensor 80 detects the user approaching the box 12 wherein the address light 82 is configured to facilitate the user in identifying the address associated with the box 12. For example, when the user is visiting the resident, rather than delivering mail, the user may want confirmation that the user is pulling up to the right property. When the motion sensor 80 detects the approach of the user to the property, the processor 46 may actuate the address light 82, providing visual confirmation to the user that the user has arrived at the desired address.

A plurality of lights 86 may be electrically coupled to the processor 46. The plurality of lights 86 may be coupled to the box 12. For example, the plurality of lights 86 may be positioned on the bottom side 22 of the peripheral wall 14. Each light of the plurality of lights 86 may be a light emitting diode. For example, the plurality of lights 86 may include a front light 88 that is positioned proximate to the open front side 16 and a rear light 90 is positioned proximate to the open rear side 18.

The processor 46 may actuate the plurality of lights 86 when the front door 28 is pivoted into the front door open position 30 wherein the plurality of lights 86 is configured to facilitate visibility of the box 12 during mail delivery. The processor 46 may also actuate the plurality of lights 86 when the rear door 34 is pivoted into the rear door open position 36, for example to facilitate visibility of the box 12 during mail retrieval. The processor 46 may actuate the plurality of lights 86 when the transceiver 50 sends the proximity alert wherein the plurality of lights 86 is configured to facilitate the user in visualizing the box 12. The processor 46 may actuate the plurality of lights 86 when the when the time of day is monitored by the clock 54 is the nighttime wherein the plurality of lights 86 is configured to facilitate the user in visualizing the box 12 during low light conditions.

A post 92 may be coupled to and extend downwardly from the bottom side 22 of the peripheral wall 14 of the box 12 wherein the post 92 is configured to support the box 12 above a surface such as a street, lawn, or sidewalk. The post 92 may be positioned between the pair of lights 86.

In use, the personal electronic device 52 may be used to activate and deactivate both the front lock 62 and the rear lock 66. For example, the proximity sensor 78 may detect the approach of the mail delivery person, and the processor 46 may activate the front lock 62 and the rear lock 66. The processor 46 may also actuate the address light 82 and the plurality of lights 86 as the mail delivery person approaches the box 12. The mail delivery person, or other user, may use the intercom button 74 to speak with the resident and explain that the mail delivery person is attempting a legitimate delivery. The resident may then use the personal electronic device 52 to deactivate the front lock 62 so that the mail delivery person can pivot the front door 28 into the front door open position 30 and deposit the delivery into the interior space 26 of the box 12. As the front door 28 opens, the processor 46 may play the informational statement audibly through the speaker 58 to help the mail delivery person confirm that the delivery is going to the correct place.

If the mail delivery person, or another user, merely attempts to open either the front door 28 or the rear door 34, the camera 76 will capture the photograph and the processor 46 will play the warning statement. The warning statement may notify the mail delivery person, or other user, that their picture has been taken because of a suspected theft attempt. The transceiver 50 may transmit the photograph to the personal electronic device 52 so that the resident can determine if further action is needed.

The resident may also view a live feed from the camera 76 using the personal electronic device 52. For example, when the personal electronic device 52 receives the proximity alert, the resident may open the live feed from the camera 76 to see who is approaching the box 12. The live feed may include audio that is picked up by the microphone 60. The resident may then remotely activate and deactivate the front lock 62 and the rear lock 66. In some embodiments, the resident may be able to speak with the individuals who are approaching the box 12, because the transceiver 50 can receive audio from the personal electronic device 52 and the processor 46 can play that audio through the speaker 58. The resident may thus be able to notify the individuals who are approaching the box 12 that they are being monitored, deterring theft attempts of mail or other objects within the box 12. The resident may also use the personal electronic device 52 to activate and deactivate the front lock 62 and the rear lock 66 when the resident is retrieving the delivered mail.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A secure mailbox assembly comprising:

a box having an open front side and an interior space;

a front door being coupled to the box, the front door being positionable to cover the open front side of the box;

a processor being coupled to the box;

a front lock being electrically coupled to the processor, the front lock being coupled to the front door, the front lock being actuatable to inhibit the front door from being opened wherein the front lock is configured to selectively inhibit access to the interior space, the front lock engaging the front door to retain the front door in a front door closed position when the front lock is activated, the front lock disengaging from the front door to allow the front door to be pivoted into a front door open position when the front lock is deactivated;

a proximity sensor being coupled to the box wherein the proximity sensor is configured to detect when a user is approaching the box, the processor being configured to actuate the front lock when the proximity sensor detects that the user is approaching the box;

a camera being electrically coupled to the processor, the processor actuating the camera to capture a photograph of the user when the user attempts to pivot the front door into the front door open position; and an address light being electrically coupled to the processor, the address light being coupled to the box, the address light including an indicium being configured to indicate a mailing address associated with the box, the processor actuating the address light when the front door is pivoted into the front door open position, the processor actuating the address light when the proximity sensor detects that the user is approaching the box wherein the address light is configured to facilitate the user in identifying the address associated with the box.

2. The secure mailbox assembly of claim 1, further comprising:

a memory unit being integrated into the processor, the memory unit storing an audio file, the audio file including a warning statement being configured to inhibit the user from tampering with the box; and a speaker being electrically coupled to the processor, the processor being configured to play the audio file audibly with the speaker when the camera captures the photograph.

3. The secure mailbox assembly of claim 2, the audio file further comprising an informational statement being configured to identify an address associated with the box.

4. The secure mailbox assembly of claim 3, further comprising a control panel being electrically coupled to the processor, the control panel being actuatable to signal the processor to actuate the front lock, the control panel including an open button being configured to signal the processor to deactivate the front lock, the processor being configured to audibly play the informational statement of the audio file audibly with the speaker when the processor deactivates the front lock, the processor being configured to play the warning statement audibly with the speaker.

5. The secure mailbox assembly of claim 1, further comprising a transceiver being electrically coupled to the processor, the transceiver being configured to wirelessly communicate with a personal electronic device, the transceiver being configured to send data to and receive data from the personal electronic device, the transceiver being configured to send audio to and receive audio from the personal electronic device, the processor being configured to play audio received from the personal electronic device audibly with the speaker.

6. The secure mailbox assembly of claim 5, further comprising a microphone being electrically coupled to the processor, the microphone being configured to detect an audio feed proximate to the box, the transceiver being configured to send the audio feed to the personal electronic device wherein the speaker and the microphone are configured to facilitate voice communication between the personal electronic device and the user.

7. The secure mailbox assembly of claim 6, further comprising a control panel being electrically coupled to the processor, the control panel being actuatable to signal the processor to actuate the front lock and the microphone.

8. The secure mailbox assembly of claim 7, the control panel further comprising:

an open button being configured to signal the processor to deactivate the front lock; and an intercom button being configured to signal the processor to actuate the microphone.

9. The secure mailbox assembly of claim 1, further comprising a clock being electrically coupled to the processor, the clock having a timer, the timer including a timer active setting and a timer inactive setting, the processor activating the front lock when the timer is in the timer active setting, the processor deactivating the front lock when the timer is in the timer inactive setting wherein the front lock disengages from the front door to allow the front door to be pivoted into the front door open position.

10. The secure mailbox assembly of claim 9, wherein the clock is configured to monitor a time of day in minutes and hours, the camera having a night vision setting being configured to capture the photograph of the user when the time of day being monitored by the clock is a nighttime having low light conditions.

11. The secure mailbox assembly of claim 10, further comprising a plurality of lights being electrically coupled to the processor, the plurality of lights being coupled to the box, the processor actuating the plurality of lights when the front door is pivoted into the front door open position, the processor actuating the plurality of lights when the when the time of day being monitored by the clock is the nighttime.

12. The secure mailbox assembly of claim 1, further comprising a motion sensor being electrically coupled to the processor, the motion sensor being coupled to the box, the motion sensor being configured to detect when the user is approaching the box, the processor actuating the address light when the motion sensor detects that the user is approaching the box.

13. A secure mailbox assembly comprising:

a box having a peripheral wall with an open front side and an open rear side, the peripheral wall having a top side, a bottom side, and a pair of lateral sides being coupled to and extending between the top side and the bottom side to define an interior space;

a front door being pivotably coupled to the box, the front door being positionable to cover the open front side of the box, the front door being pivotable between a front door open position and a front door closed position, the front door being parallel to and extending outwardly from the bottom side of the peripheral wall when the front door is in the front door open position wherein the front door open position allows access to the interior space, the front door being perpendicular to and extending upwardly from the bottom side of the peripheral wall when the front door is in the front door closed position wherein the front door closed position inhibits access to the interior space;

a rear door being pivotably coupled to the box, the rear door being positionable to cover the open rear side of the box, the rear door being pivotable between a rear door open position and a rear door closed position, the rear door being parallel to and extending outwardly from the bottom side of the peripheral wall when the rear door is in the rear door open position wherein the rear door open position allows access to the interior space, the rear door being perpendicular to and extending upwardly from the bottom side of the peripheral wall when the rear door is in the rear door closed position wherein the rear door closed position inhibits access to the interior space;

a power source being coupled to the box, the power source comprising a battery, the battery being rechargeable;

a processor being electrically coupled to the power source, the processor being positioned in the interior space adjacent to the bottom side of the peripheral wall, the processor including a memory unit, the memory unit storing an audio file, the audio file including a warning statement being configured to inhibit a user from tampering with the box, the audio file including an informational statement being configured to identify an address associated with the box;

a transceiver being electrically coupled to the processor, the transceiver being configured to wirelessly communicate with a personal electronic device, the transceiver being configured to send data to and receive data from the personal electronic device, the transceiver being configured to send audio to and receive audio from the personal electronic device;

a clock being electrically coupled to the processor, the clock being configured to monitor a time of day in minutes and hours, the clock having a timer, the timer including a timer active setting and a timer inactive setting, the timer active setting being configured to be adjustable with the personal electronic device, the timer inactive setting being configured to be adjustable with the personal electronic device;

a speaker being electrically coupled to the processor, the processor being configured to play the audio file audibly with the speaker, the processor being configured to play audio received from the personal electronic device audibly with the speaker;

a microphone being electrically coupled to the processor, the microphone being configured to detect an audio feed proximate to the box, the transceiver being configured to send the audio feed to the personal electronic device wherein the speaker and the microphone are configured to facilitate voice communication between the personal electronic device and the user, the microphone being a pinhole microphone being integrated into the speaker;

a front lock being electrically coupled to the processor, the front lock being coupled to the front door, the front lock being actuatable to inhibit the front door from being pivoted into the front door open position wherein the front lock is configured to selectively inhibit access to the interior space, the front lock engaging the front door to retain the front door in the front door closed position when the front lock is activated, the front lock disengaging the front door to allow the front door to be pivoted into the front door open position when the front lock is deactivated, the processor activating the front lock when the timer is in the timer active setting, the processor deactivating the front lock when the timer is in the timer inactive setting, the front lock being positioned on the top side of the peripheral wall of the box, the front lock being positioned in the interior space, the front lock being an electromagnetic lock;

a front door magnetically active material being coupled to the front door, the front door magnetically active material being alignable with the front lock when the front door is in the front door closed position, the front door magnetically active material being magnetically attracted to the front lock when the front lock is activated to retain the front door in the front door closed position;

a rear lock being electrically coupled to the processor, the rear lock being coupled to the rear door, the rear lock being actuatable to inhibit the rear door from being pivoted into the rear door open position wherein the rear lock is configured to selectively inhibit access to the interior space, the rear lock engaging the rear door to retain the rear door in the rear door closed position when the rear lock is activated, the rear lock disengaging the rear door to allow the rear door to be pivoted into the rear door open position when the rear lock is deactivated, the processor activating the rear lock when the timer is in the timer active setting, the processor deactivating the rear lock when the timer is in the timer inactive setting, the rear lock being positioned on the top side of the peripheral wall of the box, the rear lock being positioned in the interior space, the rear lock being an electromagnetic lock;

a rear door magnetically active material being coupled to the rear door, the rear door magnetically active material being alignable with the rear lock when the rear door is in the rear door closed position, the rear door magnetically active material being magnetically attracted to the rear lock when the rear lock is activated to retain the rear door in the rear door closed position;

a control panel being electrically coupled to the processor, the control panel being positioned on the top side of the peripheral wall adjacent to the front door, the control panel being actuatable to signal the processor to actuate the front lock and the microphone, the control panel including:

an open button being configured to signal the processor to deactivate the front lock, the processor deactivating the front lock when the timer is in the timer inactive setting, the processor being configured to audibly play the informational statement of the audio file audibly with the speaker when the processor deactivates the front lock, the processor being inhibited from deactivating the front lock when the timer is in the timer active setting;

an intercom button being configured to signal the processor to actuate the microphone;

a camera being electrically coupled to the processor, the camera being mounted to the top side of the peripheral wall, the camera being an omnidirectional camera, the processor actuating the camera to capture a photograph when the open button of the control panel is actuated while the timer is in the timer active setting, the processor being configured to actuate the camera to capture the photograph when the user attempts to pivot the front door into the front door open position while the timer is in the timer active setting, the processor being configured to actuate the camera to capture the photograph when the user attempts to pivot the rear door into the rear door open position while the timer is in the timer active setting, the processor being configured to play the warning statement of the audio file audibly with the speaker when the camera captures the photograph, the transceiver being configured to transmit the photograph to the personal electronic device, the camera having a night vision setting being configured to capture the photograph of the user when the time of day being monitored by the clock is a nighttime having low light conditions;

a proximity sensor being coupled to the box, the proximity sensor being positioned on the front door wherein the proximity sensor is configured to detect when the user is approaching the front door of the box, the processor being configured to actuate the front lock and the rear lock when the proximity sensor detects the user is approaching the box, the transceiver being configured to send a proximity alert to the personal electronic device when the proximity sensor detects the user is approaching the box;

a motion sensor being electrically coupled to the processor, the motion sensor being coupled to the box, the motion sensor being positioned on the top side of the peripheral wall, the motion sensor being configured to detect when the user is approaching the box, the motion sensor being spaced from the camera;

an address light being electrically coupled to the processor, the address light being coupled to a lateral side of the pair of lateral sides of the peripheral wall, the address light being positioned proximate to the open rear side, the address light including an indicium being configured to indicate a mailing address associated with the box, the processor actuating the address light when the front door is pivoted into the front door open position, the processor actuating the address light when the rear door is pivoted into the rear door open position, the processor actuating the address light when the transceiver sends the proximity alert, the processor being configured to actuate the address light when the motion sensor detects the user approaching the box wherein the address light is configured to facilitate the user in identifying the address associated with the box; and a plurality of lights being electrically coupled to the processor, the plurality of lights being coupled to the box, the plurality of lights being positioned on the bottom side of the peripheral wall, the processor actuating the plurality of lights when the front door is pivoted into the front door open position, the processor actuating the plurality of lights when the rear door is pivoted into the rear door open position, the processor actuating the plurality of lights when the transceiver sends the proximity alert, the processor actuating the plurality of lights when the when the time of day being monitored by the clock is the nighttime, the plurality of lights including:

a front light being positioned proximate to the open front side; and a rear light being positioned proximate to the open rear side.

* * * * *